US008685173B2

(12) United States Patent
Ahmed et al.

(10) Patent No.: US 8,685,173 B2
(45) Date of Patent: Apr. 1, 2014

(54) METHOD OF CLEANING FOOD AND BEVERAGE MANUFACTURING AND HANDLING EQUIPMENT

(75) Inventors: Fahim U. Ahmed, Greensboro, NC (US); Bruno Van Den Bossche, Wambrechies (FR)

(73) Assignee: DeLaval Holding AB, Tumba (SE)

( * ) Notice: Subject to any disclaimer, the term of this patent is extended or adjusted under 35 U.S.C. 154(b) by 456 days.

(21) Appl. No.: 13/054,004

(22) PCT Filed: Jul. 16, 2009

(86) PCT No.: PCT/US2009/050828
§ 371 (c)(1), (2), (4) Date: Mar. 29, 2011

(87) PCT Pub. No.: WO2010/009305
PCT Pub. Date: Jan. 21, 2010

(65) Prior Publication Data

US 2011/0259367 A1 Oct. 27, 2011

Related U.S. Application Data

(60) Provisional application No. 61/081,634, filed on Jul. 17, 2008.

(51) Int. Cl.
*B08B 3/00* (2006.01)

(52) U.S. Cl.
USPC ..... 134/28; 134/3; 134/22.1; 134/22.14; 134/22.19

(58) Field of Classification Search
None
See application file for complete search history.

(56) References Cited

U.S. PATENT DOCUMENTS

| | | | | |
|---|---|---|---|---|
| 6,986,817 | B2 | 1/2006 | Riefenstein et al. | |
| 2003/0015219 | A1 | 1/2003 | Kravitz et al. | |
| 2006/0035808 | A1 * | 2/2006 | Ahmed et al. | 510/499 |

FOREIGN PATENT DOCUMENTS

| | | | |
|---|---|---|---|
| CA | 2143195 | C | 6/2002 |

OTHER PUBLICATIONS

The Summons to Attend Oral Proceedings Pursuant to Rule 115(1) EPC dated Oct. 14, 2013, in European Application No. 09 798744.0.

* cited by examiner

*Primary Examiner* — Eric Golightly
(74) *Attorney, Agent, or Firm* — Hovey Williams LLP

(57) ABSTRACT

The present invention is generally directed toward methods of cleaning and descaling surfaces contaminated with food soils, especially clean-in-place systems. More particularly, the methods according to the present invention also provide for sanitizing of surfaces contaminated with food soils. Thus, there is provided a single cleaning cycle that may clean, sanitize, and descale food-soiled surfaces, and in certain embodiments, without the need for a pre-rinse step, using an acidic detergent composition comprising a fatty alkyl-1,3-diaminopropane or salt thereof in the presence of an acid selected from the group consisting of inorganic acids, organic acids, and mixtures thereof.

23 Claims, No Drawings

METHOD OF CLEANING FOOD AND BEVERAGE MANUFACTURING AND HANDLING EQUIPMENT

RELATED APPLICATION

The present application claims the benefit of U.S. Provisional Patent Application No. 61/081,634, filed Jul. 17, 2008, and is incorporated herein by reference in its entirety,

BACKGROUND OF THE INVENTION

1. Field of the Invention

The present invention is generally directed toward methods of cleaning and descaling surfaces of equipment contaminated with food or beverage soils. In addition, the methods of the present invention generally result in a substantial reduction of bacteria and/or other microorganisms present on the surfaces of the equipment. More particularly, the methods according to the present invention comprise a single cycle cleaning method that can reduce water usage or entirely obviate the need for a pre-rinse step, and is especially suited for use with clean-in-place systems.

2. Description of the Prior Art

Clean-in-place (CIP) systems are commonly used in many food industries, including dairy, beverage, brewing, and processed foodstuffs. These systems are also commonly used in the pharmaceutical and cosmetics industries. These systems are designed such that the interior pipes, vessels, process equipment, and associated fittings can be cleaned without disassembly of the equipment. Adequate cleaning of food preparation surfaces is a necessity to ensure the safety of the food supplied to consumers. This is especially true for the dairy industry, food preparation and processing plants, including food and beverage plants, and particularly in the area of milk handling and storing. Fresh milk must be immediately cooled and refrigerated after being obtained from the cow in order to prevent the milk from spoiling. Consequently, the piping systems, equipment, storage tanks, and utensil surfaces which handle the flow of milk must be cleaned after each milking in order to remove milk soils so as to prevent contamination of the fresh milk supply during subsequent milking operations. Most dairies operate using at least two milkings per day. This means that the CIP systems must be cleaned at least twice per day.

Traditionally, CIP systems in North. America (the United States and Canada) have always been cleaned using chlorinated alkaline or alkaline detergents and at least a three-step process. In the first step, the system is pre-rinsed with water at about 37-49° C. (100-120° F.). The goal in this step is to soften or melt the milk fats, without using water so hot as to denature the milk proteins and create scale. It has been conventionally thought that this step was a necessary prerequisite to the cleaning process and for scale inhibition. In the second step, the system is washed with hot water of no less than 49° C. (120° F.), and usually closer to about 70-80° C. (158-176° F.), using the chlorinated alkaline or alkaline detergent, which is circulated through the system for about 8-10 minutes. The chlorinated alkaline detergent hydrolyses and dissolves milk fats, proteins, and carbohydrates; removes protein deposits and prevents film build-up. Finally, the system is post-rinsed to remove the detergent residues. Often this step involves an acid rinse at about 38-49° C. (100-120° F.) that also helps remove scale, followed by a sanitizing step, or a single acid sanitizing rinse at about 21-38° C. (70-100° F.) using a combination acid sanitizer.

In Europe, the conventional cleaning process alternates between chlorinated alkaline detergent and acid detergent. According to these processes, one type of detergent is used for the morning cleaning, while the other type of detergent is used for the evening cleaning. These detergents are often combination cleaner-sanitizers. In the typical cleaning process, the system is pre-rinsed with ambient temperature or warm water, and then washed with hot water at about 60-80° C. using the acid or chlorinated alkaline detergent. The systems is then post-rinsed with ambient temperature water.

Chlorinated cleaning detergents are effective for cleaning CIP systems. However, the use of chlorinated alkaline detergents has several drawbacks, including corrosion and degradation of polymeric gaskets, hoses, and appliances in the milk handling equipment, as well as environmental concerns from discharge of the cleaning water from the system. Furthermore, chlorine concentrations are not easy to maintain in detersive solutions. The effectiveness of chlorine on protein soil removal diminishes as solution temperature and pH decreases. Also, chlorine can react with organic materials to form carcinogenic chlorocarbons, such as chloromethane, di- and trichloromethane, and various derivatives of chloroethane.

More recently, attempts have been made to increase the efficiency of cleaning CIP systems, as well as reduce the environmental impact of such processes, save energy, and reduce water consumption. However, conventional methods are not suitable to water re-use methods that are currently being explored. In these re-use methods, the water from the earlier cycle (i.e., the rinse water or wash water) is stored and reused for either the pre-rinse or wash water in the subsequent cleaning. However, acidic water from the post-rinse or the previous wash water partially neutralizes the alkalinity of the detergent used in the next cleaning cycle, or vice versa. This inhibits the effectiveness of the overall cleaning process and often results in the need for additional cleaning cycles thereby eliminating the benefits of recycling the water in the first place. Therefore, additional methods of improving the process of cleaning CIP systems have been sought.

WO 2005/090542 discloses a method of cleaning dairy equipment without the use of chlorine-containing alkaline detergents or a pre-rinse step. The method utilizes a cleaning solution containing at least one peroxide, which claims to take advantage of the lactoperoxidase enzymes and thiocyanate inherent in the dairy residue to be removed from the system. Lactoperoxidase and thiocyanate are disclosed in WO 2005/090542 as being a natural germicidals and antispoilants. The hydrogen peroxide in the disclosed cleaning solution activates the lactoperoxidase enzyme in the milk soil, which in turn kills the enzymes responsible for milk spoilage. A disadvantage to this system is that it is specific to dairy processing systems and would not work to clean other systems that do not have the lactoperoxidase enzymes or thiocyanate inherent in the soils to be removed from the dairy processing equipment. In addition, comparative testing of the disclosed peroxide cleaning solution indicates that there is only a 3-log reduction in the population of bacteria, which is not an acceptable level to be considered an antimicrobial or sanitizer in Europe or the United States.

Thus, there exists a real and substantial need in the art for a method or cleaning a clean-in-place system, which is not limited to dairy food or beverage processing plants using a non-chlorine, acidic detergent composition capable of cleaning and descaling food preparation surfaces in a single cleaning cycle with a reduced volume pre-rinse step or entirely without a pre-rinse step, and further sanitizing under certain conditions. There is also a need for a method of recycling water from the cleaning process that avoids problems of traditional cleaning processes.

SUMMARY OF THE INVENTION

The present invention overcomes the above problems and provides cleaning and descaling functionality in a single cleaning cycle with substantially decreased water usage, and often without a pre-rinse step, that is especially suited for CIP systems.

In one embodiment of the present invention there is provided a method that comprises a cleaning step in which the surfaces of the soil-contaminated equipment are contacted with a cleaning solution comprising an acidic detergent composition including a fatty alkyl-1,3-diaminopropane or salt thereof having the general formula R—NH—$CH_2CH_2CH_2CH_2NH_2$, wherein R is a C4-C22 alkyl group. The cleaning step is followed by a post-rinsing step in which the equipment surfaces are rinsed with a rinse solution thereby removing residues of the detergent composition remaining on the equipment. The above steps are performed without first performing a pre-rinsing step as is common in conventional CIP cleaning operations.

In another embodiment of the present invention there is provided a method of cleaning soiled food or beverage manufacturing and handling equipment comprising a cleaning step in which the surfaces of the equipment are contacted with a volume of a cleaning solution. The cleaning solution comprises an acidic detergent composition including a fatty alkyl-1,3 diaminopropane or salt thereof having the general formula R—NH—$CH_2CH_2CH_2NH_2$, wherein R is a C4-C22 alkyl group. The volume of cleaning solution is circulated through the equipment for a period of time to effect a reduction of the soils on the equipment surfaces. A post-rinsing step is then performed in which the equipment surfaces are rinsed with a rinse solution thereby removing residues of the detergent composition remaining on the equipment. The method may also include a pre-rinse step in which a volume of pre-rinse fluid is circulated through the equipment prior to said cleaning step wherein the volume of pre-rinse fluid used is less than 50% of the volume of cleaning solution used in the cleaning step.

In yet another embodiment of the present invention there is provided a method of cleaning soiled food or beverage manufacturing and handling equipment comprising a cleaning step in which the surfaces of the equipment are contacted with a volume of a cleaning solution. The cleaning solution comprises an acidic detergent composition including a fatty alkyl-1,3 diaminopropane or salt thereof having the general formula R—NH—$CH_2CH_2CH_2NH_2$, wherein R is a C4-C22 alkyl group. The volume of cleaning solution is circulated through the equipment in a plurality of passes, portions or slugs to effect a reduction of the soils on the equipment surfaces. A first portion or slug of the cleaning solution is purged from the equipment following the first pass therethrough. After the cleaning step, a post-rinsing step is then performed in which the equipment surfaces are rinsed with a rinse solution thereby removing residues of the detergent composition remaining on the equipment. The surfaces of the equipment have not undergone a pre-rinse step prior to the cleaning solution first pass.

In still another embodiment of the present invention there is provided a method of cleaning soiled food or beverage manufacturing and handling equipment without a pre-rinse step. The method comprises a cleaning step in which a first portion or slug of cleaning fluid (water only)is introduced into the equipment thereby contacting the surfaces thereof. The first portion of water effectively dilutions and residual soil that may remain in the equipment because of inadequate draining. Subsequently, a second portion or slug of cleaning fluid is introduced into the equipment thereby contacting the surfaces thereof. The second portion of cleaning fluid comprises an acidic detergent composition including a fatty alkyl-1,3 diaminopropane or salt thereof having the general formula R—NH—$CH_2CH_2CH_2NH_2$, wherein R is a C4-C22 alkyl group. The first and second portions of cleaning fluid circulate through the equipment simultaneously. A post-rinsing step is performed in which the equipment surfaces are rinsed with a rinse solution thereby removing residues of the detergent composition remaining on the equipment. The surfaces of the equipment have not undergone a pre-rinse step prior to the cleaning solution first pass.

Therefore, the present invention provides an efficient method of cleaning and descaling of surfaces of a CIP system contaminated with food or beverage soils. Further, in certain embodiments, the method can also be used to sanitize soiled surfaces. Although the invention finds particular utility for CIP treatment of dairy equipment, and beverage or food processing plants, it is not so limited. Those skilled in the art will appreciate that the claimed methods can be used to clean, sanitize, and descale a wide variety of equipment, such as heat exchangers, tanks, pipes, centrifuges, evaporators, filters, extruders, coders, coolers, sieves, hydrocyclones, and ultra-, hyper-, micro-, and nanofiltration units.

DETAILED DESCRIPTION OF THE PREFERRED EMBODIMENT

All embodiments of the present invention generally comprise both a cleaning step and a post-rinsing step. In certain embodiments, the need for any pre-rinse step is eliminated thereby saving significant quantities of water and cleaning time, However, in other embodiments, particularly those embodiments pertaining specifically to beverage handling equipment, and even more specifically to milk handling equipment, it is within the scope of the present invention to include a low-volume pre-rinse step in order to remove or flush standing beverage or milk that could not otherwise simply be drained from the equipment. As explained below, this pre-rinse step is not intended to remove excess food or beverage that is clinging to the surfaces, rather due to the design of certain CIP systems, significant quantities of free-standing beverage may remain in the system and/or system lines. Thus, in order to prevent a loss of detergent efficacy, these free-standing quantities of beverage need to be removed via a low water volume pre-rinse. Alternatively, the free standing quantities of beverage may be diluted by circulating the cleaning solutions in two portions. The first portion of cleaning solution containing only water effectively dilutes the soil that would otherwise accumulate in the first slug of cleaning solution that circulates in the system.

Although the cleaning step may be carried out by way of a number of embodiments which are discussed in detail below, generally the cleaning step involves the contacting of a surface of the handling or processing equipment that is soiled with food or beverages with a cleaning solution at a temperature of from about 25° C. to about 85° C., preferably from about 35° C. to about 80° C., and more preferably from about 40° C. to about 75° C., for a specified time period of from about 2 to about 20 minutes, preferably from about 6 to about 15 minutes, and more preferably from about 8 to about 12 minutes. Preferably, the surface is contacted with the cleaning solution by circulating the cleaning solution through the equipment for the specified period of time.

The embodiments of the present invention described herein are particularly suited for use with clean-in-place (CIP) systems such as those found on dairy farms and in a number of food and beverage processing handling facilities. One exemplary type of CIP system comprises a batch tank in which cleaning and/or rinse solutions may be held during the cleaning cycle. The batch tank provides a container for mixing the detergent into the water to be circulated through the various portions of the CIP system during the cleaning process. After completing a circuit through the equipment, the solutions are typically returned to the tank to await further circulation. Another type of CIP system foregoes the batch tank and instead utilizes apparatus for adding detergent in-line as the cleaning solution circulates through the processing equipment. The cleaning and rinsing solutions may circulate through the CIP system as substantially continuous streams, or as discrete slugs of solution separated by pockets of air.

In one embodiment of the present invention, the cleaning step is performed without having first performed any kind of pre-rinse step. As commonly understood, a "pre-rinse" step is a procedure by which typically fresh water is circulated through the handling or processing equipment at a temperature of between about 35° C. to about 40° C. in order to remove or loosen various soils so as to conserve detergent or improve the cleaning efficacy of the cleaning step. Typically, the volume of water used in the pre-rinse step is roughly the same as the volume of cleaning solution and post-rinse solution that are circulated through the system during the cleaning and rinsing steps, respectively. However, generally, the volume of water used in the pre-rinse step is at least 75% of the volume of cleaning solution that is used during the cleaning step.

In another embodiment of the present invention, a volume of cleaning solution is circulated through the handling or processing equipment in a plurality of passes to effect a reduction of the soils on the equipment surfaces. However, after the first pass of the cleaning solution, a first portion of the cleaning solution is purged from the equipment. In certain embodiments this first portion constitutes the "first runnings" or the first slug of cleaning solution to pass through the equipment. As discussed above, certain CIP system contain significant quantities of food or beverage that, due to the system design, cannot be automatically drained from the system. This first portion of cleaning solution contacts the free-standing food or beverage remaining in the system prior to the cleaning step and "drives" it out of the system. Accordingly, this first portion of cleaning solution is purged so as to not reduce the efficacy of the remaining detergent within the system. The remaining cleaning solution is continued to be passed through the equipment for the remainder of the cleaning step. In certain embodiments, the first portion of cleaning solution that is purged from the equipment comprises less than 25% by volume of the total volume at cleaning solution circulated during the first pass. In other embodiments, the purged portion comprises less than 15%, or less than 5% of the total volume of cleaning solution circulated during the first pass. By purging the first slug of cleaning solution after the first pass, the need for a conventional pre-rinse step is eliminated thereby conserving considerable amounts of fresh water.

In another embodiment of the present invention, the cleaning step comprises introducing a first portion of a cleaning fluid, preferably fresh water, into the equipment thereby contacting the surfaces thereof. Subsequently, a second portion of cleaning fluid is introduced into the equipment thereby contacting the surfaces thereof. The second portion of cleaning fluid comprises an acidic detergent composition. The first and second portions of cleaning fluid are circulated simultaneously through the equipment for the duration of the cleaning step. Note, in this embodiment, the first portion of cleaning fluid is not purged from the system. In this embodiment, the first portion of cleaning fluid picks up and dilutes the free-standing quantities of food or beverage remaining in the system so as not to reduce the effectiveness of the detergent that is contained within the second portion of cleaning fluid. Again, the need for a pre-rinse step is eliminated thereby conserving water. In certain embodiments, the first portion of cleaning fluid comprises less than 25% by volume of the total cleaning fluid used in the cleaning step. In other embodiments, the first portion of cleaning fluid comprises less than 15%, or less than 5% by volume of the total cleaning fluid used in the cleaning step.

In yet another embodiment of the present invention, a pre-rinse step is performed prior to the cleaning step. However, the volume of pre-rinse fluid used is less than 50% of the volume of cleaning solution used in the cleaning step. In other embodiments, the volume of pre-rinse fluid used is less than 40%, preferably less than 25%, and most preferably less than 10% of the volume of cleaning solution used in the cleaning step. It is the primary function of the pre-rinse step to reduce the amount of "free-standing" food or beverage that cannot otherwise be drained from the system prior to the cleaning step. Therefore, it is not a target goal of the pre-rinse step to loosen or remove soils that are adhered to the surfaces of the equipment. Rather, the pre-rinse is primarily intended to reduce the amount of food or beverage to an acceptable level that does unacceptably interfere with or prevent the detergent used in the cleaning step from effecting the necessary system cleaning. Thus, the pre-rinse step may employ lower temperatures than conventional pre-rinse operations, thereby resulting in additional energy savings. For example, the pre-rinse solution or fluid may have a temperature of less than 35° C., less than 30° C., less than 25° C., between about 10° C. to about 35° C., or between about 15° C. to about 30° C.

It has been discovered that in order to obtain effective cleaning from the cleaning step, the food or beverage handling and processing equipment should contain less than 12% by volume of residual food or beverage, based upon the volume of cleaning solution to be circulated through the equipment, prior to the cleaning step, or at least prior to the introduction of detergent into the equipment during the cleaning step. In certain embodiments, the level of such food or beverage soils should be less than 10% by volume, or even less than 5% by volume, based upon the volume of cleaning solution to be circulated through the equipment.

After the specified time period, the surface is rinsed. In the rinsing step, the surface is contacted with a rinse solution for a sufficient time to remove any cleaning solution residue. Preferably, the rinse solution comprises fresh water (i.e., water that has yet to be cycled through the equipment). Preferably, the surface is rinsed for a specified period of from about 2 to about 20 minutes, and more preferably from about 4 to about 16 minutes, at a temperature of from about 5° C. to about 40° C., preferably from about 10° C. to about 35° C., and more preferably from about 15° C. to about 30° C. After the rinsing step, the surface is clean and descaled. Thus, in a single cleaning cycle the inventive method provides for the removal of at least about 90% of the food and/or beverage soil on the equipment surface, preferably from about 90%-99.9% of the soil is removed, and more preferably from about 95-98%, based upon the initial amount of food and/or beverage soil on the equipment surface prior to the cleaning cycle.

The inventive method also preferably sanitizes the surface at cleaning temperatures of at least about 40° C., resulting in at least a 4-log reduction, and more preferably at least a 5-log reduction, in the amount of bacteria or microorganisms on the target surface after a single cleaning cycle. As used herein, the term "cleaning cycle" refers to a single cleaning step, followed by a post-rinse step, and in certain embodiments, without a pre-rinse step. Thus, in certain embodiments, in a single cleaning cycle, a soiled surface is not pre-rinsed, but is first contacted with the cleaning solution for a specified period of time, and is then rinsed with the rinsing solution to directly thereafter yield a surface that is cleaned, sanitized, and desealed.

In one embodiment, the cleaning solution is run through the equipment for a single cleaning cycle and then drained from the equipment and discarded. That is, once the cleaning solution is drained after the single cleaning cycle, it is not reintroduced into the equipment during a subsequent cleaning cycle. Thus, in this embodiment, the cleaning solution is a single-use solution.

In another embodiment according to the invention, the rinse water is recovered after the rinsing step and reused during a subsequent cleaning cycle. Preferably, the rinse water is diverted to a holding tank after the rinsing step and is used in the cleaning solution of a subsequent cleaning cycle. According to this embodiment, a quantity of the detergent composition is introduced into the recovered rinse solution to produce a cleaning solution for the subsequent cleaning cycle having the desired detergent concentration, as described herein.

The cleaning solution comprises a non-chlorine detergent composition that provides cleaning and descaling functionality, and is also capable of providing sanitizing under certain conditions. The preferred cleaning compositions for use in the cleaning solutions of the present invention are described in U.S. Patent Application Publication 2006/0035808, incorporated by reference herein in its entirety. These detergent compositions comprise a fatty alkyl-1,3-diaminopropane or salt thereof, and one or more inorganic and/or organic acids. In addition, the detergents may also include low-foaming non-ionic surfactants, as well as coupling agents. The compositions can also include one or more additional ingredients such as one or more sequesterants, builders, and chelating agents. It is also particularly preferable to include a quantity of a lower-alkyl sulfonic acid (such as methanesulfonic acid) to further enhance the cleaning performance of the composition. A particularly preferred cleaning composition is commercially available under the name Zone™, from DeLaval Manufacturing. As mentioned above, it is preferred that the cleaning solution is discarded after a single cleaning cycle; although the rinse water can be recovered and reused in the cleaning solution of a subsequent cleaning cycle. In an alternative embodiment, the cleaning solution can also be saved and re-used for other types of cleaning such as external surface cleaning of the milking parlor. However, it is preferable that the cleaning solution not be re-used in the CIP system.

The detergent concentrates to be used with the present cleaning methods preferably comprise from about 0.01-5% by weight of a fatty alkyl 1,3-diaminopropane or salt thereof, based upon the total weight of the composition taken as 100% by weight. The fatty alkyl-1,3-diaminopropanes for use in the cleaning composition have the general formula $$R—NH—CH_2CH_2CH_2NH_2,$$

wherein R is a substituted or unsubstituted, straight or branch, saturated or unsaturated C4-C22 alkyl group in an acid matrix. It is preferable that the R group correspond as closely as possible to the fatty alkyl group distribution of the soil being cleaned. Preferably, the fatty alkyl-1,3-diaminopropane is derived from natural sources, such as coconut, soy, tallow, or oleo sources. Fatty alkyl-1,3-diaminopropanes can be used as amines or can be converted into diamine salts through a reaction with low alkyl carbon acids such as formic acid, acetic acid, or any other organic acids. Mono and diacetate salts of fatty alkyl-1,3-propylenediamines (alone or in combination) are particularly preferred. The mono and diacetate salts are prepared in situ by mixing of the amines with controlled amounts of acetic acid prior to adding any other ingredients.

Particularly preferred diaminopropane compositions are commercially available from Akzo Nobel under the name DUOMEEN. The DUOMEEN family includes Duomeen® Coco Alkyl), Duomeen® CD (Distilled Coco Alkyl), Duomeen® S (Soya Alkyl), Duomee® SV (Soya Alkyl vegetable derived), Duomeen® O (Oleo Alkyl), Duomeen® OL (Oleo Alkyl), Duomeen® (Tallow Alkyl). These compositions are also available as diacetate salts, a neutralized product formed with acetic acid, such as Duomac® T (Tallow Alkyl diacetate salts) and Armohib® B-101. Additional diaminopropane compositions are available from Clariant under the name GENAMIN and includes Genamin® OLP 100 (Oleyl propylenediamine), Genamin® TAP 100 (Tallow Alkyl propylenediamine), Genamin® TAP 100 D (Tallow Alkyl propylenediamine, distilled), Genamin® LAP 100 (Lauryl propylenediamine). Yet additional diaminopropane compositions are available from Corsicana Technologies under the name CORSAMINE, such as Corsamine® DC (Coco Alkyl), Corsamine® DO (Oleo Alkyl), and Corsamine® DT (Tallow Alkyl). Other specific examples of fatty alkyl-1,3-propylenediamines are disclosed in U.S. Patent Application Publication 2006/0035808, and are incorporated by reference herein.

The detergent concentrates also preferably comprises from about 1-80% by weight acid (either organic or inorganic), more preferably from about 10-60% by weight, and even more preferably from about 15-50% by weight based on the total weight of the composition taken as 100% by weight. The acids for use in the composition can be any organic or inorganic acids known to those skilled in the art. Preferred organic acids include weak C1 to C4 carboxylic acids such as acetic acid, hydroxyacetic acid, propionic acid, hydroxypropionic acid, a-ketopropionic acid, citric acid, butyric acid, mandelic acid, valeric acid, succinic acid, tartaric acid, malic acid, oxalic acid, fumaric acid, adipic acid, or mixtures thereof. Other preferred organic acids include maleic acid, sorbic acid, benzoic acid, glutaric acid, adipic acid, α-hydroxy acids such as glycolic acid and lactic acid, ethylenediaminetetraacetic acid (EDTA), phosphonic acid, octyl phosphonic acid, acrylic acid, polyacrylic acid, aspartic acid, polyaspartic acid, p-hydroxybenzoic acids, and combinations thereof. Yet additional preferred organic acids are those having the general formula $R^1—SO_3H$ wherein $R^1$ is a C1-C16 alkyl group.

Preferred inorganic acids include mineral acids such as sulfuric acid, nitric acid, phosphoric acid, sulfamic acid, hydrochloric acid, and mixtures thereof. Methanesulfonic acids, sulfamic acids, and phosphoric acids are also helpful in descaling soiled surfaces.

Preferably, the inventive detergent compositions comprise water soluble acids in sufficient concentration to provide use solutions having a pH from about 0.1-5.5 preferably from about 1.0-3.5, more preferably from about 1.5-3.0, and most preferably from about 2.0-2.5. Exemplary water soluble acids include citric acid, phosphoric acid, methanesulfonic acid and sulfamic acid. Phosphoric acid is particularly advantageous acid because it also provides some hydrotropic properties to solubilize nonionic surfactants that may be incorporated with the detergents. Phosphoric acid, methanesulfonic acid, and sulfamic acid are also particularly advantageous for use in cleaning dairy pipelines as they tend to dissolve milk stone.

Surfactants are important ingredients in detergents because they impart beneficial properties to the detergents, such as wetting, lowering surface tension, and cleaning assistance. However, many surfactants tend to foam when agitated. In CIP systems, because it is desirable to create as short a wash time as possible, excessive or long lasting foam is highly undesirable. CIP systems are particularly prone to foaming due to the agitation and slug action of the cleaning detergents. Also, protein soils, in general, naturally tend to produce foam. Therefore, it is important in the context of these systems to select surfactants which are non-foaming or very low foaming for use in accordance with the claimed method, However, in applications where foaming is not a concern, such as the cleaning of utensil surfaces or storage tanks, high foaming surfactants may be used.

A number of different surface active agents can be used in the present method and include anionic, nonionic, cationic, amphoteric, and zwitterionic surfactants, or mixtures thereof which are stable in highly acidic conditions. Specific examples of such surfactants are described in detail in U.S. Patent Application Publication 2006/0035808 and arc incorporated by reference herein. Preferably, detergent concentrate compositions for use according to the present method comprise from about 0-15% by weight of a surfactant, more preferably from about 0.10-15% by weight, even more preferably from about 0.50-10% by weight, still more preferably from about 1.0-8% by weight, and most preferably, from about 2-6% by weight. Mixtures of two or more surface active agents are particularly preferred for the claimed method.

Nonionic surfactants tend to lower the detergent surface tension, improve the wettability of the surface being cleaned, and solubilise the soils in the inventive detergents. Thus, these are particularly preferred for use in the claimed method of cleaning CIP systems. Preferred nonionic surfactants include capped or uncapped poly-lower alkoxylated higher alcohols or ether derivatives thereof, in which the alcohol or ether contains 9 to 18 carbon atoms and the number of moles of lower alkylene oxide (2 or 3 carbon atoms) is from 3 to 12. Exemplary alkyl alkoxylated alcohols are available from RASP under the name PLURAFAC (Fatty alcohol alkoxylates) such as, Plurafac® LF-303 (polyglycol ether), Plurafac® LF-305 (C8-C14 alkyl chain), Plurafac® S-305LF, Plurafac® SLIT-18B (C6-C10 ethoxylated linear alcohol), Plurafac® SLF-18B45, and Plurafac® LF-4030, Another preferred nonionic surfactant is available from Clariant under the name GENAPOL®, such as GENAPOL® EP 0244 (Alkyl alkoxylate).

Even more preferably, the claimed method involves a dual surfactant system using two different nonionic surfactants, which surprisingly, was found to result in less foaming in the CIP system when compared with cleaning methods including single surfactant systems.

It is also preferred that the compositions include the lower alkanesulfonic acid, methanesulfonic acid, $CH_3SO_3H$, at a level of about 0-40% by weight of a lower alkyl sulfonic acid, more preferably from about 1-30% by weight, even more preferably from about 2-25% by weight, and most preferably from about 5-20% by weight, based upon the total weight of the composition taken as 100% by weight. Methanesulfonic acid is a strong organic acid (pKa=−1.9) distinguished by a particularly high capacity for solvating numerous heavy metals. It was discovered that the addition of methanesulfonic acid to the detergent formulations used in the claimed method greatly improved the cleaning performance of the detergent, especially in removing protein films. Methanesulfonic acid and its metal salts are highly soluble in water, and less corrosive than other strong inorganic acids. Methanesulfonic acid is biodegradable and recyclable. Methanesulfonic acid is generally less toxic than fluoroboric acid and fluorosilicic acid. Other lower alkyl ($C_1$-$C_{16}$) carbon chain sulfonic acids may be used in the claimed method, such as ethanesulfonic acid, propanesulfonic acid, and butanesulfonic acid.

As noted above, the claimed method preferably provides cleaning and descaling functionality in a single cleaning step with a single cleaning product, which is also capable of providing sanitizing under certain conditions. Thus, it is desirable for the compositions used in the claimed method to include antibacterial and sanitizing agents. Specific examples of antibacterial and sanitizing agents that can be included in compositions used with the claimed method are provided in U.S. Patent Application Publication 2006/0035808, and are incorporated by reference herein. However, it is preferred that the compositions used in the present method are substantially free of any peroxides, such as hydrogen peroxide. As used herein the term "substantially free," means that the composition contains less than about 0.01% by weight of peroxide. Even more preferably, the compositions contain no peroxides.

Particularly preferred coupling agents for use in the claimed method include nontoxic biodegradable monohydric alcohols, selected polyhydric alcohols, aromatic alcohols, and aliphatic alcohols. Preferred monohydric alcohols are selected from the group consisting of isopropyl, methyl, ethyl, propyl, isopropyl, n-butyl, isobutyl, Cert-butyl, benzyl, and allyl alcohols, and mixtures thereof. Preferred polyhydric alcohols are selected from the group consisting of propylene glycol, 1,3-propanediol, 1,2-butanediol, polyethylene glycol 400, glycerol, and 1,4-butanediol, and mixtures thereof. It is particularly preferred to use a monohydric alcohol in combination with a polyhydric alcohol in the cleaning compositions of the claimed method. These agents are preferably included in the compositions used with the present method at a level of up to about 20% by weight coupling agent, more preferably from about 0.5-10% by weight, even more preferably from about 1-8% by weight, and most preferably from about 1.5-6% by weight, based upon the total weight of the composition taken as 100% by weight.

Finally, compositions used in the claimed method can include sequestrants, builders, and chelating agents to soften or treat water and to prevent the formation of precipitates or other salts in the CIP system. Generally, sequestrants complex or coordinate the metal ions commonly found in the service water and thereby prevent the metal ions from interfering with the functioning of the detersive components within the composition. Preferred examples of these optional ingredients are disclosed in U.S. Patent Application Publication 2006/0035808, and are incorporated by reference herein.

The detergent concentrate is capable of being diluted with water to form a use solution (i.e., the cleaning solution). Preferably, the concentrate is diluted at a weight ratio of between is diluted at a weight ratio of between about 1:10 to 1:400, more preferably between about 1:50 to 1:300, and most preferably between about 1:100 to 1:250. The dilution ratio, when expressed as a percentage of the volume of detergent concentrate per total volume of solution, may be from about 0.2 to about 0.8%, preferably from about 0.3 to about 0.6%, more preferably from about 0.4 to about 0.5%, and most preferably about 0.4%. The p11 of the diluted use solution is preferably less than about 5.5, preferably between about 0.1-5.5, more preferably between about 1.0-3.5, even more preferably between about 1.5-3.0, and most preferably between about 2.0-2.5.

EXAMPLES

The following examples set forth preferred cleaning methods in accordance with the invention. It is to be understood, however, that these examples are provided by way of illustration and nothing therein should be taken as a limitation upon the overall scope of the invention.

Example 1

Cleaning Performance of Single Cycle Method

The cleaning efficacy of the claimed method was tested. First, soiled panels were prepared according to the following procedure. Sixty-three stainless steel, plastic, or glass panels measuring 3"×6"×0.0037", having a ¼ inch hole at one end were at first washed with a powder chloro-alkaline detergent, rinsed with water and wiped with xylene, then with isopropanol, followed by drying in an oven (100-110° C., for 10-15 minutes) to insure complete evaporation of the solvents. The panels were suspended in the oven by attaching a rigid wire hanger to the panel hole, so that no contact was made with the oven or other items within the oven. The dried panels were then removed from the oven, and allowed to cool for at least 20 minutes. The panels were then carefully handled so as to eliminate contact with soil sources, and the initial weight of each panel was recorded to the nearest 0.1 mg.

Three 12 fl. oz. (354 mL) cans of Nestle Carnation evaporated milk were emptied into to a 1 L beaker, along with one 12 fl. oz. (354 mL) can of de-ionized water to make a 75% solution of Carnation Milk as the milk soil. The mixtures were stirred to insure homogeneity. The panels were placed in the milk by setting the end without the hole on the bottom of the beaker and propping the other end of the panel against the side of the beaker. Approximately ⅞ of the panel was immersed in the milk. The panels were allowed to sit in the milk for 15 minutes and then drained in the air for 5 minutes. Each panel side was then rinsed with 50 ml of 400 ppm of synthetic hard water previously heated to 90-100° F. Care was taken to pour the rinse water over each side of the panel so as to contact all of the soiled areas of the panel. The rinse water was allowed to drain off each panel and then the panels were hung in a 40° C. oven to dry. The panels were then removed from the oven and allowed to cool for at least 15 minutes. After cooling, the panels were weighed and each weight was recorded to the nearest 0.1 mg. The soil deposition, rinsing, drying and weighing cycle was carried out a total of five times for each panel, or until the soil weight fell within the range of about 18-30 mg.

The soiled panels were then washed in a 1 L beaker using a cleaning solution at varying temperatures without pre-rinsing the panels with water. The cleaning solution was prepared by mixing the ingredients as shown in Table 1 below, and diluting to a 0.4% use concentration.

TABLE1

| Ingredient | Percentage (w/w)[1] | Use Concentration 0.4% (v/v) Percentage (w/w)[1] |
|---|---|---|
| Water | 60.50 | 0.02735 |
| Acetic Acid | 0.25 | 0.0011 |
| Fatty alkyl 1,3-diaminopropane[2] | 0.25 | 0.0011 |
| Genapol EP 0244[3] | 2.00 | 0.0090 |
| Plurafac SLF 18B-45[4] (100%) | 1.00 | 0.0045 |
| Phosphoric acid, 75% | 15.00 | 0.0678 |
| Methanesulfonic acid, 70% | 15.00 | 0.0678 |
| Isopropyl alcohol, 99% | 3.00 | 0.0136 |
| Propylene glycol, USP | 3.00 | 0.0136 |
| Acid Red 27[5] | 0.0025 | ~0.0000 |
| TOTAL | 100.00 | 0.4520 |

[1]Based upon the total weight of the composition taken as 100% by weight.
[2]Genamin OLP 100 (available from Clariant) or Duomeen SV (available from Akzo Nobel)
[3]Low-foaming nonionic surfactant available from Clariant
[4]Nonionic surfactant available from BASF
[5]Acid stable dye To test additional organic soil load, Carnation Evaporated Milk was added to the heated cleaning solution at 1%, 2%, 3%, 4%, 5%, 8%, and 10% milk solutions, respectively, and allowed to mix for 2 minutes. For each concentration of milk, the cleaning solution was heated to three different temperatures, 40° C., 50° C., and 60° C., respectively, using a hot plate. The pH of the cleaning solution at each temperature was recorded. For each temperature three different test panels were used. Thus, a total of nine panels were tested for each milk solution.

Each test panel was first immersed in the cleaning solution for a period of 8 minutes with agitation via a magnetic stir bar, while the designated temperature was maintained with a hot plate. After the wash, each panel was removed from the wash bath and immediately rinsed in tap water for about 5 seconds. The panel was then suspended within an oven at about 40° C. for a period of about 15 minutes to dry. The panel was removed from the oven. cooled in the air for about 30 minutes and then reweighed. The weight of the panel after the wash cycle was then compared with the soiled weight thereof before the wash cycle to determine the percent soil removed. The results are provided in Table 2 below.

TABLE 2

| Panel # | Temperature/ pH | Initial Weight (g) | Soiled Weight (g) | Total Amount of Soil (g) | Weight After Cleaning (g) | Weight of Soil Removed (g) | % Soil Removed | Average Cleaning % |
|---|---|---|---|---|---|---|---|---|
| 0.4% Use Cleaning Solution/1% Milk in Solution | | | | | | | | |
| 1 | 60° C./2.33 | 81.9718 | 81.9935 | 0.0217 | 81.9727 | 0.0208 | 95.85 | 97.52 |
| 2 | | 82.1387 | 82.1643 | 0.0256 | 82.139 | 0.0253 | 98.83 | |
| 3 | | 82.7153 | 82.7388 | 0.0235 | 82.7158 | 0.0230 | 97.87 | |
| 4 | 50° C./2.32 | 80.9883 | 81.0115 | 0.0232 | 80.9889 | 0.0226 | 97.41 | 97.65 |
| 5 | | 81.0394 | 81.0656 | 0.0262 | 81.0396 | 0.0260 | 99.24 | |
| 6 | | 80.8349 | 80.862 | 0.0271 | 80.8359 | 0.0261 | 96.31 | |

TABLE 2-continued

| Panel # | Temperature/ pH | Initial Weight (g) | Soiled Weight (g) | Total Amount of Soil (g) | Weight After Cleaning (g) | Weight of Soil Removed (g) | % Soil Removed | Average Cleaning % |
|---|---|---|---|---|---|---|---|---|
| 7 | 40° C./2.31 | 80.7595 | 80.7835 | 0.0240 | 80.7599 | 0.0236 | 98.33 | 96.86 |
| 8 | | 81.1913 | 81.2102 | 0.0189 | 81.1917 | 0.0185 | 97.88 | |
| 9 | | 82.2456 | 82.2687 | 0.0231 | 82.2469 | 0.0218 | 94.37 | |
| 0.4% Use Cleaning Solution/2% Milk in Solution | | | | | | | | |
| 10 | 60° C./2.36 | 81.7295 | 81.7592 | 0.0297 | 81.73 | 0.0292 | 98.32 | 98.25 |
| 11 | | 81.6970 | 81.7184 | 0.0214 | 81.6972 | 0.0212 | 99.07 | |
| 12 | | 81.9070 | 81.9297 | 0.0227 | 81.9076 | 0.0221 | 97.36 | |
| 13 | 50° C./2.35 | 82.8677 | 82.8921 | 0.0244 | 82.8683 | 0.0238 | 97.54 | 96.42 |
| 14 | | 80.2189 | 80.2413 | 0.0224 | 80.2196 | 0.0217 | 96.88 | |
| 15 | | 82.7143 | 82.7356 | 0.0213 | 82.7154 | 0.0202 | 94.84 | |
| 16 | 40° C./2.33 | 82.6858 | 82.7063 | 0.0205 | 82.6877 | 0.0186 | 90.73 | |
| 17 | | 82.4381 | 82.4661 | 0.0280 | 82.4387 | 0.0274 | 97.86 | 94.28 |
| 18 | | 82.4823 | 82.5067 | 0.0244 | 82.4837 | 0.0230 | 94.26 | |
| 0.4% Use Cleaning Solution/3% Milk in Solution | | | | | | | | |
| 19 | 59° C./2.36 | 82.3467 | 82.3708 | 0.0241 | 82.3477 | 0.0231 | 95.85 | 96.93 |
| 20 | | 82.2124 | 82.2352 | 0.0228 | 82.2129 | 0.0223 | 97.81 | |
| 21 | | 81.4139 | 81.4382 | 0.0243 | 81.4146 | 0.0236 | 97.12 | |
| 22 | 50° C./2.36 | 80.5758 | 80.6034 | 0.0276 | 80.5762 | 0.0272 | 98.55 | 97.35 |
| 23 | | 81.8754 | 81.9 | 0.0246 | 81.8762 | 0.0238 | 96.75 | |
| 24 | | 82.8787 | 82.9033 | 0.0246 | 82.8795 | 0.0238 | 96.75 | |
| 25 | 40° C. | 80.0772 | 80.1081 | 0.0309 | 80.0814 | 0.0267 | 86.41 | 87.48 |
| 26 | | 82.3512 | 82.3758 | 0.0246 | 82.3544 | 0.0214 | 86.99 | |
| 27 | | 80.4590 | 80.4873 | 0.0283 | 80.4621 | 0.0252 | 89.05 | |
| 0.4% Use Cleaning Solution/4% Milk in Solution | | | | | | | | |
| 28 | 60° C. | 80.5393 | 80.5667 | 0.0274 | 80.5402 | 0.0265 | 96.72 | 91.02 |
| 29 | | 80.7273 | 80.7458 | 0.0185 | 80.7296 | 0.0162 | 87.57 | |
| 30 | | 82.2801 | 82.3095 | 0.0294 | 82.2834 | 0.0261 | 88.78 | |
| 31 | 51° C. | 80.2476 | 80.2725 | 0.0249 | 80.2497 | 0.0228 | 91.57 | 91.40 |
| 32 | | 80.1684 | 80.1879 | 0.0195 | 80.1704 | 0.0175 | 89.74 | |
| 33 | | 82.6031 | 82.634 | 0.0309 | 82.6053 | 0.0287 | 92.88 | |
| 34 | 41° C. | 80.5885 | 80.6209 | 0.0324 | 80.5935 | 0.0274 | 84.57 | 85.55 |
| 35 | | 80.3454 | 80.375 | 0.0296 | 80.3495 | 0.0255 | 86.15 | |
| 36 | | 80.7729 | 80.7985 | 0.0256 | 80.7765 | 0.0220 | 85.94 | |
| 0.4% Use Cleaning Solution/5% Milk in Solution | | | | | | | | |
| 37 | 60° C. | 81.3186 | 81.3438 | 0.0252 | 81.3228 | 0.0210 | 83.33 | 89.85 |
| 38 | | 80.6691 | 80.699 | 0.0299 | 80.6717 | 0.0273 | 91.30 | |
| 39 | | 80.5116 | 80.5391 | 0.0275 | 80.513 | 0.0261 | 94.91 | |
| 40 | 51° C. | 80.1872 | 80.2125 | 0.0253 | 80.1904 | 0.0221 | 87.35 | 85.51 |
| 41 | | 82.0546 | 82.0837 | 0.0291 | 82.0585 | 0.0252 | 86.60 | |
| 42 | | 80.1004 | 80.1308 | 0.0304 | 80.1057 | 0.0251 | 82.57 | |
| 43 | 40° C. | 82.8346 | 82.8604 | 0.0258 | 82.84 | 0.0204 | 79.07 | 78.75 |
| 44 | | 82.2038 | 82.23 | 0.0262 | 82.2098 | 0.0202 | 77.10 | |
| 45 | | 80.8186 | 80.8482 | 0.0296 | 80.8245 | 0.0237 | 80.07 | |
| 0.4% Use Cleaning Solution/8% Milk in Solution | | | | | | | | |
| 46 | 60° C. | 83.0724 | 83.1014 | 0.0290 | 83.0756 | 0.0258 | 88.97 | 87.17 |
| 47 | | 82.0111 | 82.0355 | 0.0244 | 82.0143 | 0.0212 | 86.89 | |
| 48 | | 81.9869 | 82.0092 | 0.0223 | 81.9901 | 0.0191 | 85.65 | |
| 49 | 50° C. | 82.8086 | 82.8322 | 0.0236 | 82.8122 | 0.0200 | 84.75 | 85.01 |
| 50 | | 82.1283 | 82.1521 | 0.0238 | 82.1315 | 0.0206 | 86.55 | |
| 51 | | 82.9641 | 82.9887 | 0.0246 | 82.9681 | 0.0206 | 83.74 | |
| 52 | 40° C. | 82.5984 | 82.6257 | 0.0273 | 82.6023 | 0.0234 | 85.71 | 81.06 |
| 53 | | 81.6834 | 81.7041 | 0.0207 | 81.6882 | 0.0159 | 76.81 | |
| 54 | | 82.4871 | 82.5083 | 0.0212 | 82.4912 | 0.0171 | 80.66 | |
| 0.4% Use Cleaning Solution/10% Milk in Solution | | | | | | | | |
| 55 | 60° C. | 82.7672 | 82.7895 | 0.0223 | 82.7718 | 0.0177 | 79.37 | 84.07 |
| 56 | | 81.4589 | 81.4885 | 0.0296 | 81.4631 | 0.0254 | 85.81 | |
| 57 | | 79.4333 | 79.4618 | 0.0285 | 79.437 | 0.0248 | 87.02 | |
| 58 | 50° C. | 80.2776 | 80.3006 | 0.0230 | 80.281 | 0.0196 | 85.22 | 82.84 |
| 59 | | 82.6223 | 82.6437 | 0.0214 | 82.6263 | 0.0174 | 81.31 | |
| 60 | | 79.7592 | 79.7842 | 0.0250 | 79.7637 | 0.0205 | 82.00 | |
| 61 | 40° C. | 82.5880 | 82.6093 | 0.0213 | 82.5936 | 0.0157 | 73.71 | 81.85 |
| 62 | | 82.7265 | 82.7541 | 0.0276 | 82.7298 | 0.0243 | 88.04 | |
| 63 | | 81.6425 | 81.6721 | 0.0296 | 81.6473 | 0.0248 | 83.78 | |

Example 2

Additional Acidic Detergent Formulations for Single Cycle Method

In this Example, the amount and type of ingredients in the acidic detergent formulations were varied and tested for cleaning performance. The formulations were also evaluated for stability over a 14 day period, when stored at 40° C. and 45° C., respectively. The formulations are provided in Table 3 below, along with the corresponding cleaning performance. To test the average % cleaning, each formulation was diluted to a 0.25% (v/v) use concentration and was tested at 60° C. All of the use solutions showed stability over a period of 14 days.

TABLE 3

| | Formulation | | | | |
|---|---|---|---|---|---|
| Ingredients (w/w)[1] | A | B | C | D | E |
| Water | 48.51 | 48.00 | 60.50 | 8.35 | 10.00 |
| Acetic acid 100% | 0.33 | 0.50 | 0.25 | 0.33 | 0.50 |
| Fatty alkyl 1,3-diaminopropane[2] | 0.33 | 0.50 | 0.25 | 0.33 | 0.50 |
| Genapol EP 0244 | 2.60 | 2.50 | 2.00 | — | — |
| Plurafac 18B-45 | 1.44 | 1.50 | 1.00 | 1.95 | 1.50 |
| Phosphoric acid 75% | 19.50 | 25.00 | 15.00 | 45.50 | 45.00 |
| Methanesulfonic Acid | 19.50 | 15.00 | 15.00 | — | — |
| Isopropanol | 3.90 | 3.50 | 3.00 | — | — |
| Propylene Glycol | 3.90 | 3.50 | 3.00 | 3.90 | 3.00 |
| Plurafac LF303 | — | — | — | 1.95 | 2.50 |
| Citric Acid (Anhydrous) | — | — | — | 0.00 | 0.00 |
| Sodium Xylene Sulphonate 40% | — | — | — | 32.50 | 30.00 |
| Emery 658 | — | — | — | 1.30 | 2.00 |
| Glycolic Acid 70 | — | — | — | 3.90 | 5.00 |
| Plurafac S-305LF | — | — | — | — | — |
| Total | 100.00 | 100.00 | 100.00 | 100.00 | 100.00 |
| Average Cleaning % | 81% | 79% | 83% | 83% | 84% |

[1]Percentage by weight, based upon the total weight of the composition taken as 100% by weight.
[2]Genamin OLP 100 (available from Clariant) or Duomeen SV (available from Akzo Nobel)

Example 3

Comparison of Single Cycle Method Using Chlorinated Alkaline Detergent

In this Example, the cleaning efficacy of the claimed method using the cleaning solution from Table 1 was compared to a commercially available liquid chloro alkaline detergent sold under the name Dynamate II, available from DeLaval Manufacturing. The same procedures outlined in Example 1 were followed using a 0.4% use solution of liquid Dynamite II detergent to clean milk soiled panels. A control was also prepared and cleaning efficacy was evaluated without any additional milk soil in the cleaning solution. The cleaning performance of the detergent was then tested using from 1-10% additional milk soil loads in the cleaning solutions as described in Example 1 above. The results for the commercially available chloro alkaline detergent versus the cleaning solution from Example 1 are summarized in Table 4 below.

TABLE 4

| Use concentration/milk concentration | Wash Temperature (° C.) | Table 1 Solution Average % of Soil Removed | Dynamate II Solution Average % of Soil Removed |
|---|---|---|---|
| Detergent 0.4% Solution/ No Additional Milk Soil | 60 | 95 | 99 |
| | 50 | 91 | 99 |
| | 40 | 86 | 97 |
| Detergent 0.4% Solution/ 1% Additional Milk Soil | 60 | 98 | 67 |
| | 50 | 98 | 87 |
| | 40 | 97 | 84 |
| Detergent 0.4% Solution/ 2% Additional Milk Soil | 60 | 98 | 67 |
| | 50 | 96 | 71 |
| | 40 | 94 | 64 |
| Detergent 0.4% Solution/ 3% Additional Milk Soil | 59 | 97 | 71 |
| | 50 | 97 | 67 |
| | 40 | 88 | 67 |
| Detergent 0.4% Solution/ 4% Additional Milk Soil | 60 | 91 | 64 |
| | 51 | 91 | 63 |
| | 41 | 86 | 58 |
| Detergent 0.4% Solution/ 5% Additional Milk Soil | 60 | 90 | 57 |
| | 51 | 86 | 60 |
| | 40 | 79 | 55 |
| Detergent 0.4% Solution/ 8% Additional Milk Soil | 60 | 87 | 60 |
| | 50 | 85 | 61 |
| | 40 | 81 | 52 |
| Detergent 0.4% Solution/ 10% Additional Milk Soil | 60 | 84 | 63 |
| | 50 | 83 | 67 |
| | 40 | 82 | 64 |

As can be seen from Table 4 above, there was a substantial decrease in the cleaning performance of the commercially-available chloro alkaline detergent in the single cycle cleaning method as the load of additional milk soil is increased in the cleaning solution. A 30-35% performance loss was observed in the Dynamate II solution compared to the cleaning solution from Table 1. In addition, once the soil load reached 4%, the cleaning performance of Dynamate II remained virtually the same, removing only about 60% of the soil load. This was believed to be due to the higher levels of residual milk soil (that are normally removed via the pre-rinse) eventually depleting the chlorine in the Dynamate II solution, leaving only the alkaline cleaner to clean the remaining milk soil. This decreased performance was not seen in the cleaning solution from Table 1. For example, when looking at the 10% milk soil load, there was a 34-37% decrease in average cleaning performance compared to the no soil load for the Dynamate II solution, while the cleaning solution from Table 1 only experienced a 4-10% decrease under identical wash conditions.

We claim:

1. A method of cleaning soiled food or beverage manufacturing and handling equipment comprising:

a cleaning step in which the surfaces of said equipment are contacted with a volume of a cleaning solution comprising an acidic detergent composition including a fatty alkyl-1,3 diaminopropane or salt thereof having the general formula R-NH-CH $_2$CH$_2$CH$_2$NH$_2$, wherein R is a C4-C22 alkyl group, wherein said volume of cleaning solution is circulated through said equipment for a period of time to effect a reduction of soils on said equipment surfaces;

a post-rinsing step in which said equipment surfaces are rinsed with a rinse solution thereby removing residues of said detergent composition remaining on said equipment; and a pre-rinse step in which a volume of pre-rinse fluid is circulated through said equipment prior to said cleaning step wherein the volume of pre-rinse fluid used is less than 50% of the volume of cleaning solution used in said cleaning step.

2. The method of claim 1, wherein said cleaning solution is circulated through said equipment in a plurality of passes to effect a reduction of the soils on said equipment surfaces, wherein a first portion of the cleaning solution is purged from said equipment following the first pass therethrough.

3. The method of claim 2, wherein said first portion of the cleaning solution that is purged from said equipment comprises less than 25% by volume of the total volume of cleaning solution circulated during said first pass.

4. The method of claim 2, wherein said first potion of the cleaning solution comprises a first runnings of said cleaning solution through said equipment.

5. The method of claim 1, wherein said cleaning step comprises introducing a first cleaning fluid into said equipment and contacting the surfaces thereof, and subsequently introducing said cleaning solution into said equipment and contacting the surfaces thereof, said first cleaning fluid and said cleaning solution circulating through said equipment simultaneously.

6. The method of claim 5, wherein said first cleaning fluid comprises fresh water.

7. The method of claim 5, wherein said first cleaning fluid comprises less than 25% by volume of the total cleaning fluid used in said cleaning step.

8. The method of claim 7, wherein said first cleaning fluid is not purged from said equipment during said cleaning step.

9. The method of claim 1, wherein said cleaning solution is substantially free of peroxides.

10. The method of claim 1, wherein said rinse solution comprises fresh water.

11. The method of claim 1, wherein said cleaning step comprises a single cleaning cycle wherein said cleaning solution is run through said equipment, drained from said equipment, and then discarded.

12. The method of claim 1, wherein said cleaning solution, once drained from said equipment, is not reintroduced into said equipment during a subsequent cleaning cycle.

13. The method of claim 1, said cleaning solution having a temperature of between about 25° C. to about 85° C. during said cleaning step.

14. The method of claim 1, said equipment surfaces being contacted with said cleaning solution for a time period of from about 2 to about 20 minutes.

15. The method of claim 1, wherein said method results in at least a 90% reduction in the soils present on said equipment surfaces, or at least a 4-log reduction in the level of bacteria present on said equipment surfaces.

16. The method of claim 1, wherein said rinse solution is recovered after said post-rinsing step and reused in the cleaning solution of a subsequent cleaning step.

17. The method of claim 16, wherein a quantity of said detergent composition is introduced into said recovered rinse solution in order to produce a cleaning solution having a detergent concentration of between about 0.2% by volume to about 0.8% by volume.

18. The method of claim 1, said cleaning solution having a pH of between about 0.1 to about 5.5.

19. The method of claim 1, said equipment being a Clean-In-Place system.

20. The method of claim 1, said equipment comprising milk- and beverage-handling equipment.

21. The method of claim 1, wherein the volume of pre-rinse fluid used in said pre-rinse step is less than 25% of the volume of the cleaning solution used in said cleaning step.

22. The method of claim 1, wherein the volume of pre-rinse fluid used in said pre-rinse step is less than 10% of the volume of the cleaning solution used in said cleaning step.

23. The method of claim 1, wherein said pre-rinse step reduces an amount of milk soils present in said equipment to less than 12% by volume based upon the volume of the cleaning solution used in said cleaning step.

* * * * *